US005589254A

United States Patent [19]

Dischler

[11] Patent Number: 5,589,254

[45] Date of Patent: Dec. 31, 1996

[54] METHOD FOR IMPROVING THE ENERGY ABSORPTION OF A HIGH TENACITY FABRIC DURING A BALLISTIC EVENT

[75] Inventor: Louis Dischler, Spartanburg, S.C.

[73] Assignee: Milliken Research Corporation, Spartanburg, S.C.

[21] Appl. No.: 441,470

[22] Filed: May 15, 1995

Related U.S. Application Data

[62] Division of Ser. No. 880,045, May 7, 1992, Pat. No. 5,466, 503.

[51] Int. Cl.[6] ..... F41H 1/02; F41H 1/04

[52] U.S. Cl. ..... 428/221; 28/299; 28/259; 428/408; 428/911; 2/2.5

[58] Field of Search ..... 428/911, 408, 428/409; 2/2.5; 28/299, 259, 260

[56] References Cited

U.S. PATENT DOCUMENTS

| | | | |
|---|---|---|---|
| 2,771,384 | 11/1956 | Collins | 154/52.5 |
| 3,409,907 | 11/1968 | Barratt | 2/2.5 |
| 3,563,836 | 2/1971 | Dunbar | 161/38 |
| 3,829,899 | 8/1974 | Davis | 2/2.5 |
| 4,443,506 | 4/1984 | Schmolmann et al. | 428/102 |
| 4,623,574 | 11/1986 | Harpell et al. | 428/113 |
| 5,175,040 | 12/1992 | Harpell et al. | 428/113 |

FOREIGN PATENT DOCUMENTS

| | | | |
|---|---|---|---|
| 2931110 | 7/1979 | Germany | F41H 01/02 |

*Primary Examiner*—Patrick Ryan
*Assistant Examiner*—Rich Weisberger
*Attorney, Agent, or Firm*—Kevin M. Kercher; Terry Moyer

[57] ABSTRACT

A method for increasing the energy absorption of a fabric constructed of high tenacity fiber. This method modifies the ballistic stress-deflection curve of the fabric by effectively toughening the fabric by controlling the peak stresses generated in the fabric layer. These stresses are controlled by perforating the fabric into relatively narrow portions or cutting the fabric into relatively narrow strips, preferably along the bias. This unexpected property is counter-intuitive to known expertise in this area in that the weakening of the fabric by cutting or perforating actually improves the ballistic performance.

2 Claims, 8 Drawing Sheets

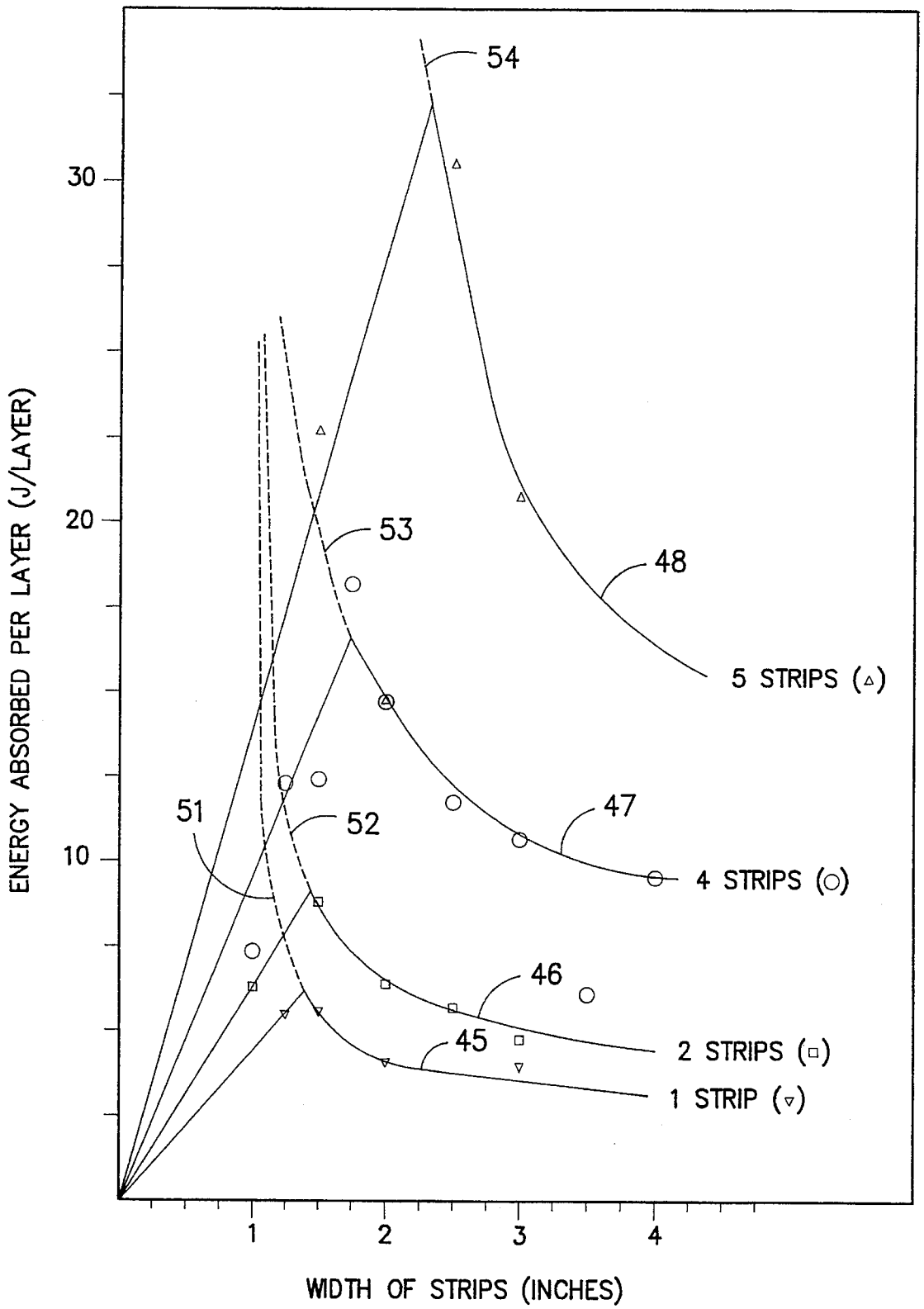
*FIG. —9—*

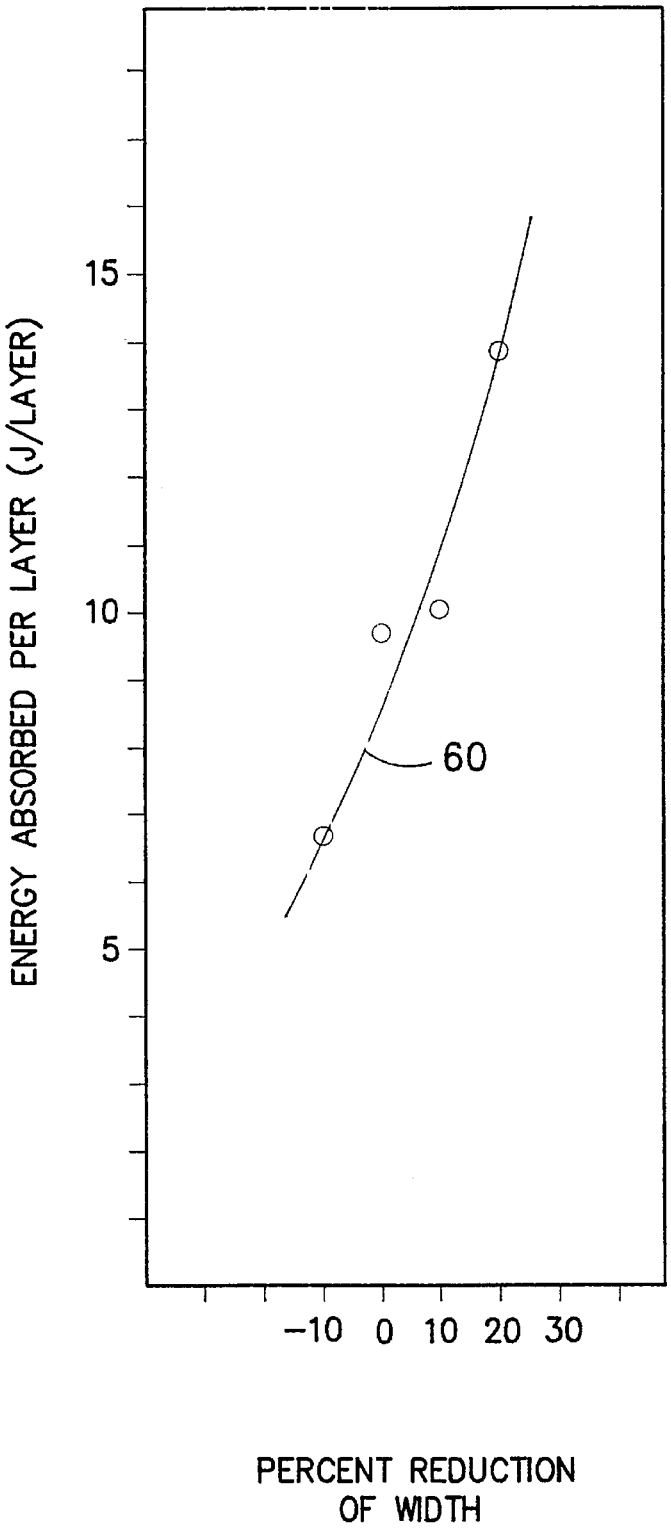
*FIG. −10−*

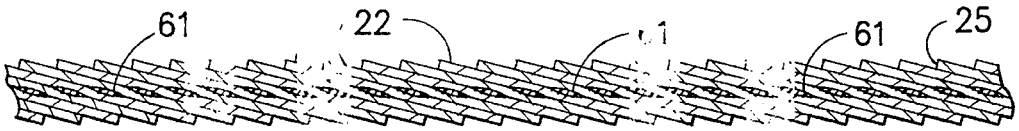
FIG. –11–
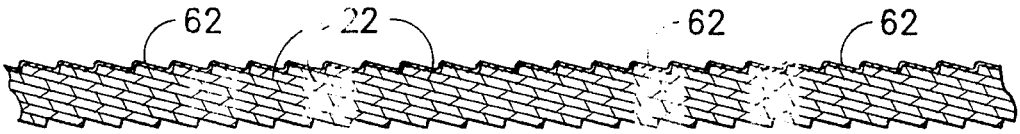
FIG. –12–
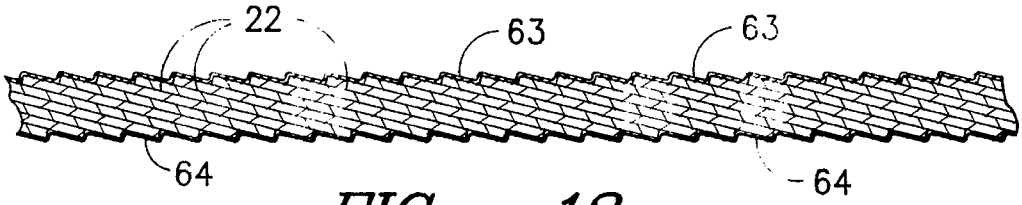
FIG. –13–
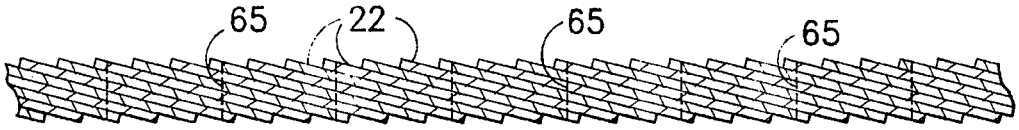
FIG. –14–
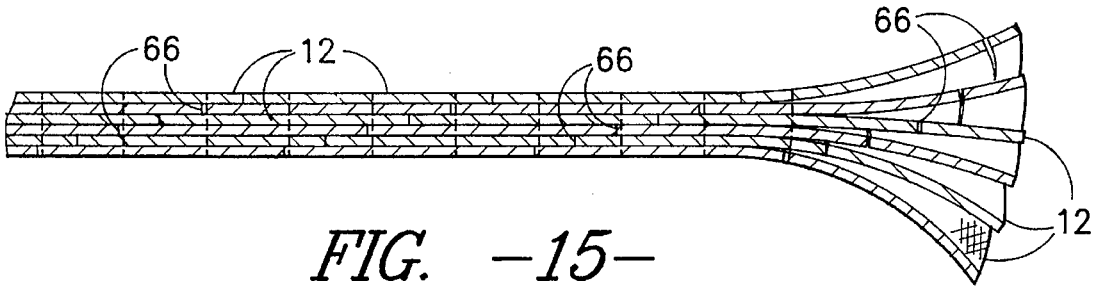
FIG. –15–

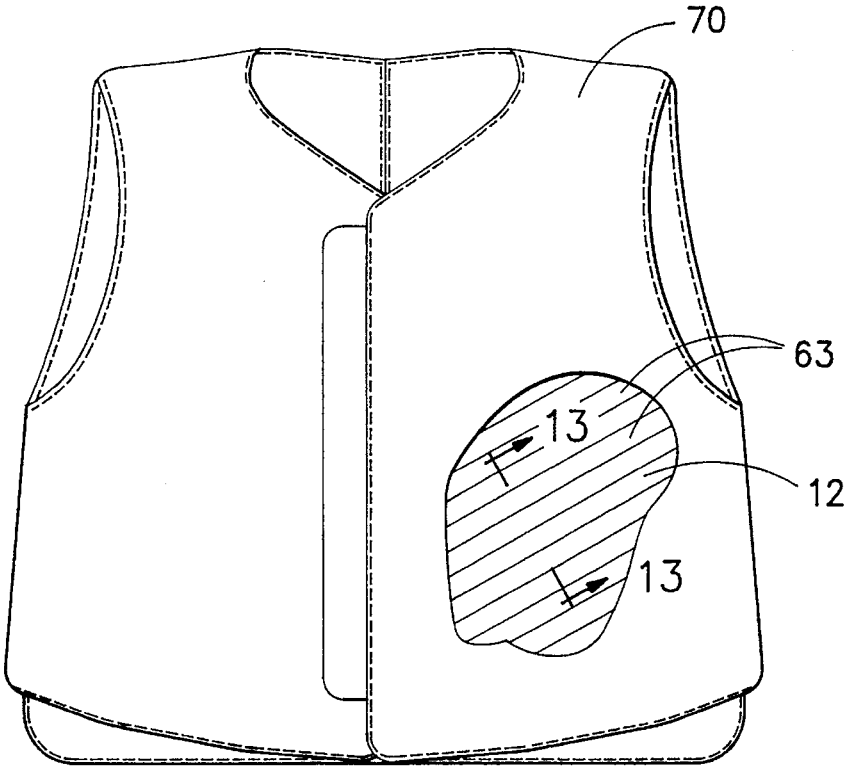
FIG. –16–
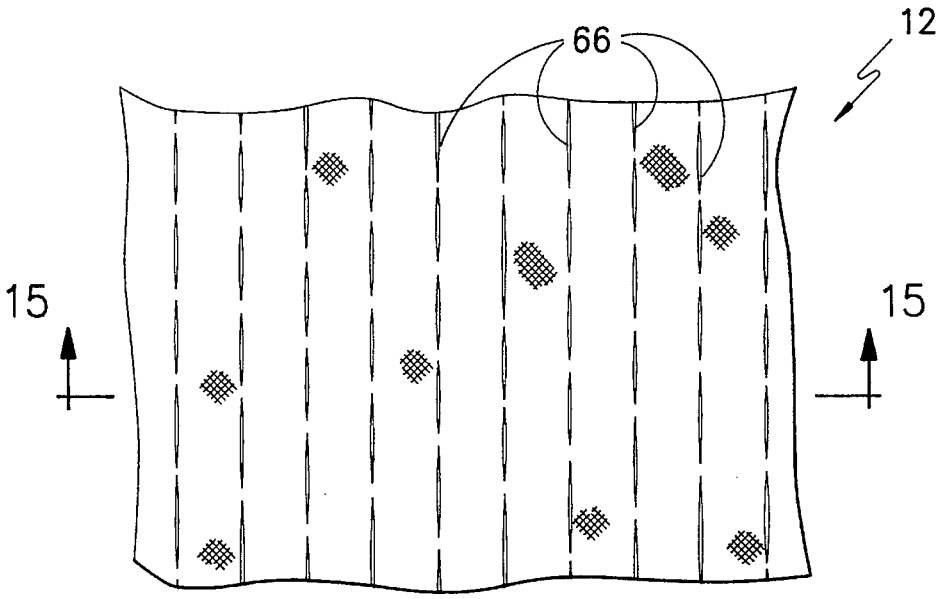
FIG. –17–

METHOD FOR IMPROVING THE ENERGY ABSORPTION OF A HIGH TENACITY FABRIC DURING A BALLISTIC EVENT

This is a divisional application of patent application Ser. No. 07/880,045, filed May 7, 1992 now U.S. Pat. No. 5,466,503, for METHOD FOR IMPROVING THE ENERGY ABSORPTION OF A HIGH TENACITY FABRIC DURING A BALLISTIC EVENT.

BACKGROUND OF THE INVENTION

This invention relates to improving the energy absorption of a high tenacity fabric during a ballistic event. Some traditional ballistic articles include personal protective (bulletproof) vests and other items of clothing, structural members of military vehicles, and so forth. High tenacity fibers include both lyotropic liquid crystal fibers such as an aromatic polyamide (polyaramid) and thermotropic liquid crystal fibers such as fully aromatic polyester. Other high tenacity fibers-include graphite, nylon, glass, high molecular weight polyvinyl alcohol, high molecular weight polypropylene, high molecular weight polyethylene, and the like. In many applications, the fibers are used in woven or knitted fabric. For other applications, the fibers are encapsulated or embedded in a composite material. Furthermore, the fabric can be coated or selectively coated with elastomers such as rubber or a polymer film.

Therefore, it would be highly desirable to modify the ballistic stress-deflection curve of a high tenacity fabric, effectively toughening the fabric by controlling the peak stresses generated in the fabric layer.

SUMMARY OF THE INVENTION

This invention concerns a method for increasing the energy absorption of a fabric constructed of high tenacity fiber. This method modifies the ballistic stress-deflection curve of the fabric by effectively toughening the fabric by controlling the peak stresses generated in the fabric layer. These stresses are controlled by perforating the fabric into relatively narrow portions or cutting the fabric into relatively narrow strips, preferably along the bias. This unexpected property is counter-intuitive to known expertise in this area in that the weakening of the fabric by cutting or perforating actually improves the ballistic performance.

An advantage of this invention is that the energy absorption of ballistic fabric is noticeably improved by the cutting or perforating of the fabric.

A second advantage of this invention is that when the fabric if either cut into strips or perforated into relatively narrow portions smaller than the maximum width of the base of the pyramid of deflection created by impact with a projectile, then the yarns at the apex of the pyramid of deflection will not reach the breaking stress.

A third advantage of this invention is that the number of layers of ballistic material utilized in stopping a projectile is far less then the traditional uncut or unperforated sheets.

A fourth advantage of this invention is that the projectile is asymmetrically loaded upon impact with the ballistic fabric to further limit peak stresses.

These and other advantages will be in part apparent and in part pointed out below.

BRIEF DESCRIPTION OF THE DRAWINGS

The above as well as other objects of the invention will become more apparent from the following detailed description of the preferred embodiments of the invention, when taken together with the accompanying drawings, in which:

FIG. 9 is a graph of energy absorption per layer versus the width of strip for one, two, three, four and five clamped layers;

FIG. 10 is a graph of energy absorption versus percent reduction of width of the strip;

FIG. 11 is a cross-sectional view of a construction of ballistic fabric cut in strips and spot glued along the center line of the longitudinal axis of the strips of ballistic fabric;

FIG. 12 is a cross-sectional view of a construction of ballistic fabric cut in strips and glued along one side of the construction;

FIG. 13 is a cross-sectional view of a construction of ballistic fabric cut in strips and glued along both sides of the construction taken on line 13—13 of FIG. 16;

FIG. 14 is a cross-sectional view of a construction of ballistic fabric cut in strips and stitched together;

FIG. 15 is a cross-sectional view of a construction of ballistic fabric whereby the ballistic fabric has a series of perforations therein taken on line 15—15 of FIG. 17;

FIG. 16 is a perspective view of a personal-protective (bulletproof) vest utilizing ballistic fabric cut in strips and glued along both sides of the construction;

FIG. 17 is a top plan detailed view taken of one layer of ballistic fabric whereby the ballistic fabric has a series of perforations therein;

Corresponding reference characters indicate corresponding parts throughout the several views of the drawings.

DETAILED DESCRIPTION OF THE PREFERRED EMBODIMENT

Figure 1:
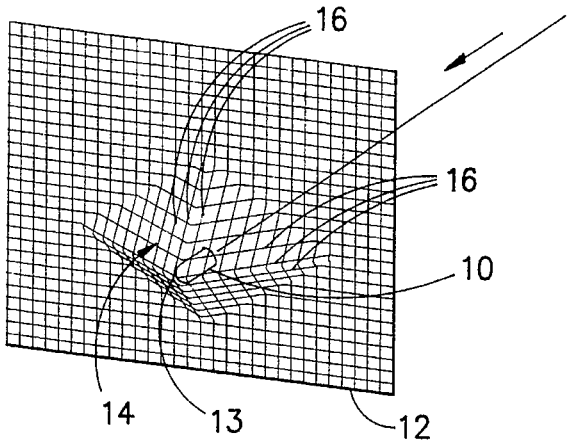
FIG. 1 is a perspective view of a projectile impacting a high tenacity ballistic fabric and creating a pyramid of deflection.

For the purposes of this Application, ballistic fabrics are those formed from high tenacity fibers. High tenacity fibers are generally defined as having a tenacity of at least ten grams per denier. High tenacity fibers include liquid crystal fibers. This would include both lyotropic and thermotropic liquid crystal fibers. A mere illustration of a type of thermotropic liquid crystal fiber is a fully aromatic polyester and a mere illustration of a lyotropic liquid crystal fiber would be an aromatic polyamide (polyaramid). An example of a fully aromatic polyester fiber is VECTRAN® manufactured by Hoechst Celanese Corporation and described in U.S. Pat. No. 4,479,999 which is incorporated herein by reference. An example of an aromatic polyamide includes high modulus aramid fibers such as poly(para-phenylene terephthalamide). Such high modulus fibers are hereinafter known as HM-aramid fibers. An example of a HM-aramid fiber is KEVLAR® manufactured by E. I. du Pont Nemours and Co. and described in U.S. Pat. No. 4,198,494, which is incorporated herein by reference. Other high tenacity fibers include graphite, nylon, glass, high molecular weight polyvinyl alcohol, high molecular weight polypropylene, high molecular weight polyethylene, and the like. In many applications, the fibers are used in woven or knitted fabric. For other applications, the fibers are encapsulated or embedded in a composite material. Some composite bonding compounds include matrices of olefin polymers and copolymers, unsaturated polyester resins, epoxy resins, and other resins curable below the melting point of the fiber. Other bonding compounds include phenolic/polyvinyl butral resin matrices, interstitial resin, elastomer matrices, among others. An example of a network of high modulus fibers coated with a matrix of elastomer is manufactured by Allied Corporation and described in U.S. Pat. No. 4,623,574, which is incorporated herein by reference.

Furthermore, the fabric can be coated or selectively coated with elastomers such as rubber. Furthermore, matrices of olefin polymers and copolymers, unsaturated polyester resins, epoxy resins, and other resins curable below the melting point of the fiber will also improve ballistic qualities.

Ballistic fibers can also be coated with a polymer film such as that disclosed in Kuhn et al., U.S. Pat. No. 4,803,096, U.S. Pat. No. 4,877,646, U.S. Pat. No. 4,981,718, U.S. Pat. No. 4,975,317 and U.S. Pat. No. 5,030,508, which are all hereby incorporated by reference. A polypyrrole film when deposited onto a ballistic fiber such as KEVLAR® completely adheres to the fibers of the substrate with very few fiber to fiber bonds. Other films such as polyaniline can also be utilized if the coefficient of friction is higher than the high tenacity fiber of the base fabric.

This invention is directed to all applications where ballistic-resistance is desired. A non-limiting list of these applications include: personal protection (bulletproof) vests, spall shields, blast blankets, hardened cargo containers for aircraft and other vehicles, helmets, structural members and panels for vehicles, briefcases, coats, umbrellas, and so forth.

The term projectile utilized in this Application is preferably a bullet projected at relatively high velocity, however, any number of analogous high velocity projectiles will suffice such as fragments, flechettes, and so forth. High velocity is hereby defined by speeds of at least five hundred feet per second (500 feet/second).

Figure 4:
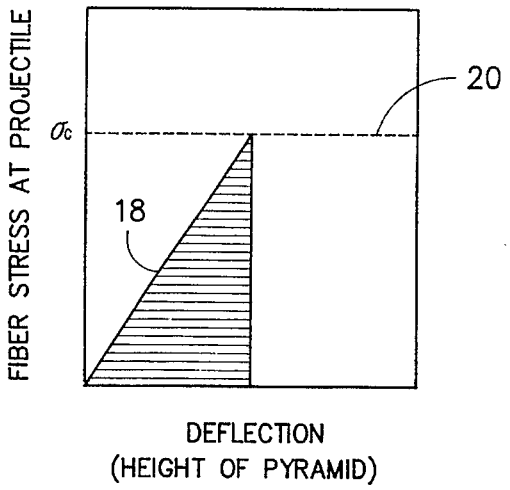
FIG. 4 is a graph of the stress developed in a piece of ballistic fabric as shown in FIG. 1 at the point of impact versus the deflection of the fabric by the projectile.

Referring now to FIG. 1, a projectile 10 is shown impacting a single layer of ballistic fabric 12 such as that formed of poly(para-phenylene terephthalamide) fibers (Kevlar®), where warp and weft are indicated schematically. Yarns 16 in the ballistic fabric 12 are put into tension by the impact of a projectile 10, e.g., bullet, and this tension creates a pyramid of deflection 14 of fabric 12. The corners of the pyramid of deflection 14 lie on a line beginning with the impacting projectile 10 and are directed along the warp and weft. The apex of the pyramid of deflection 14 is indicated by numeral 13. As shown in FIG. 4, the fiber stress developed in the yarns at the point in which the projectile 10 strikes the ballistic fabric 12 is plotted versus the deflection of the ballistic fabric as the projectile interacts with the fabric layer. Assuming the projectile does not slow much during impact, the stress builds up in a linear fashion until the breaking strength of the yarns near the point of impact (apex 13) by the projectile 10 is reached. The critical stress at the breaking strength of the yarns is indicated by the horizontal dashed line 20. The energy absorbed by the layer of ballistic fabric 12 is equal to the shaded area under the curve 18. The curve 18 plots the fiber stress versus deflection (height of the pyramid of deflection 14).

Figure 2:
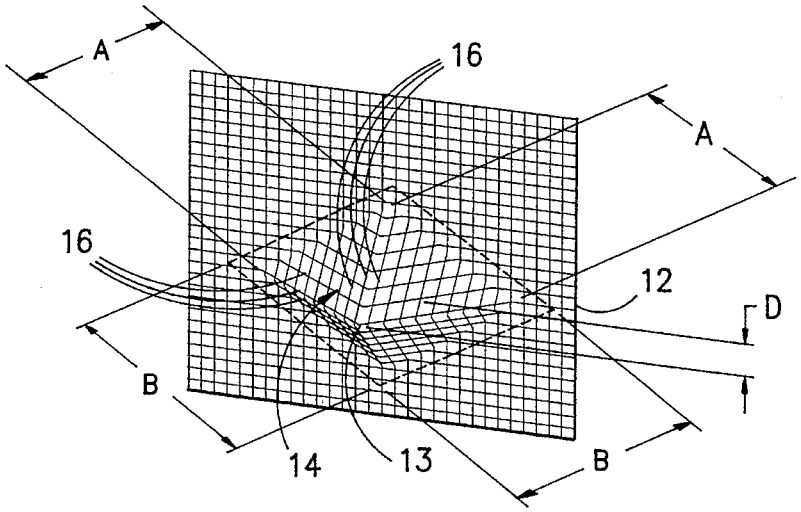
FIG. 2 is a perspective view of the ballistic fabric disclosed in FIG. 1 wherein the base of the pyramid of defection is denoted by the letter "B" when the pyramid of deflection is at the breaking stress.

Referring now to FIG. 2, each side of the base of the pyramid of deflection 14 is indicated by the distance "A". Therefore, the total circumferential length of the base of the pyramid of deflection 14 would be 4A. This total circumferential length of the base of the pyramid of deflection 14 increases directly with the height of the pyramid of deflection 14, indicated by the distance "D". The fabric making up the pyramid of deflection 14 has already been accelerated to the velocity of the projectile 10 while the circumferential fabric at the base of the pyramid of deflection 14 is being actively accelerated to the projectile velocity. Since the height of the pyramid of deflection 14 measured from the apex 13 is also the deflection, the total circumferential length of the base of the pyramid of deflection 14 is directly proportional to the deflection as well as the amount of ballistic fabric 12 being accelerated at any one time. The maximum value of A is B, at which point the stress in the ballistic fabric 12 at the point of impact by the projectile 10 reaches the tensile limit. This length B varies with the fabric type and strength and with the threat level to be protected against. When the length A of the base of the pyramid of deflection 14 reaches B, then the ballistic fabric 12 at the point the projectile 10 impacts the fabric (apex 13) will fail since the breaking stress will be reached. If the ballistic fabric is cut strip-wise just within the B dimension, then the stress will not reach the breaking stress.

Figure 3:
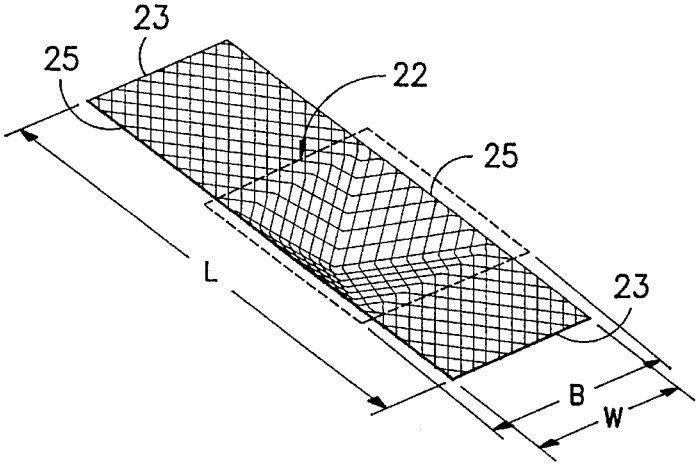
FIG. 3 is a perspective view of a strip of ballistic fabric having a width "W" smaller than the base "B" of the deflection pyramid shown in FIG. 2, thereby preventing the yarns at the apex of the pyramid of deflection from reaching the breaking stress.

An example of a ballistic fabric strip 22 is shown in FIG. 3 with a width W and a length L and having two horizontal ends 23 and two vertical edges 25. The width W is just less than the B dimension. In this case, the energy is absorbed by accelerating the strip of ballistic fabric 22 until either the projectile 10 is stopped or the stress waves reach both of the two horizontal ends 23 of the strip of ballistic fabric 22. A ballistic failure ratio is hereby defined as the width W divided by the B dimension. Therefore, the ballistic failure ratio should always be less than one in order to prevent the ballistic fabric strip 22 (from reaching the breaking strength of the fibers at the apex 13. In order that the energy absorption of the strip be greater than the energy absorption of the parent fabric, the total area accelerated-by the projectile must be greater, that is, the area L×W must be larger than the area of B×B. Equivalently, the length L of a strip of ballistic fabric 22 divided by the width W of said strip of ballistic fabric 22 must be greater than the square of the reciprocal of the ballistic failure ratio: $L/W>(B/W)^2$.

Figure 5:
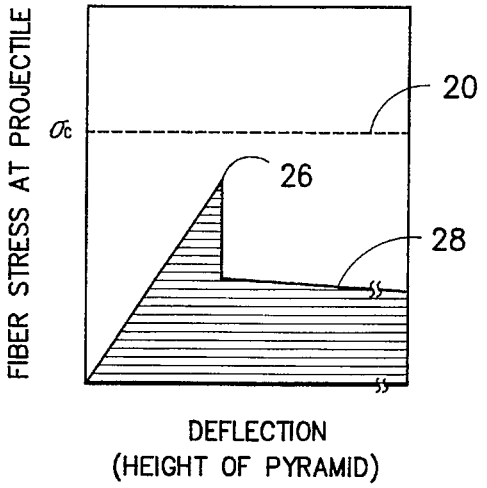
FIG. 5 is a graph of the stress developed in a strip of ballistic fabric as shown in FIG. 3 at the point of impact versus the deflection of the fabric by the projectile.

FIG. 5 reveals a graph of fiber stress at the impact point of projectile 10 analogous to FIG. 4, in this case for a ballistic fabric strip 22 instead of a sheet of ballistic fabric 12. The shaded area under the curve 24, which is the energy absorbed by the strip of ballistic fabric 22, never reaches the stress breaking point 20 of the ballistic fabric strip 22 and merely reaches a peak designated by numeral 26 before entering into a relatively constant lower plateau designated by numeral 28, which is proportional to the width of the fabric strip 22 and the square of the projectile velocity. Transients associated with the sudden release of stress as the deflection pyramid 14 reaches either or both of the vertical edges 25 of the strip of ballistic fabric 22 are neglected here as they do not affect total energy absorption significantly.

Figure 6:
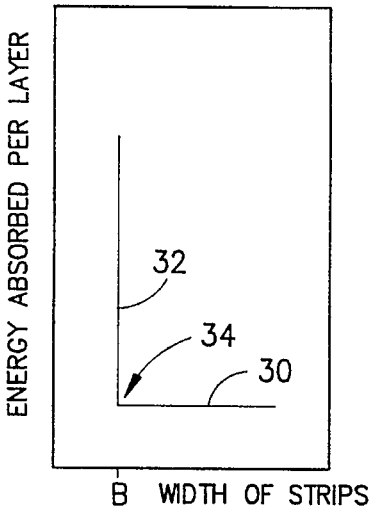
FIG. 6 is a graph of the ideal curve of energy absorbed per layer versus the width of the strips of ballistic fabric whereby the energy absorbed per layer remains constant until the width of the strips of fabric are less than the base of the pyramid of deflection of the fabric at the breaking stress.
Figure 7:
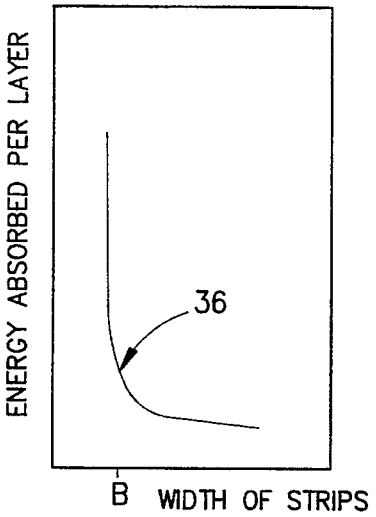
FIG. 7 is a graph of the actual curve of energy absorbed per layer versus the width of the strips of ballistic fabric whereby the energy absorbed increases as the width of the fabric decreases with the most marked change occurring when the width of the strip is less than the base of the pyramid of deflection of the fabric at the breaking stress.

As the width of the ballistic fabric strip 22 is reduced, starting at a relatively wide strip, the energy absorbed stays constant, as indicated by numeral 30 in FIG. 6, until the width of the ballistic fabric strip 22 is less than the length of the base B of the pyramid of deflection 14. At this point, indicated by numeral 32 in FIG. 6, the energy absorbed becomes indefinitely great, since it is no longer limited by the breaking stress of the ballistic fabric 12. This ideal curve, found in FIG. 6, designated by the numeral 34 represents the energy absorbed per layer versus the width of ballistic fabric strip 22 and is a didactic simplification of the actual curve designated by numeral 36, found in FIG. 7, which also represents the energy absorbed per layer versus the width of ballistic fabric strip 22. The actual curve 36 is much smoother than the ideal curve 34 due to random variations in fabric and in projectile velocity. Furthermore, the data in the actual curve 36, shown in FIG. 7, have been averaged.

Figure 8:
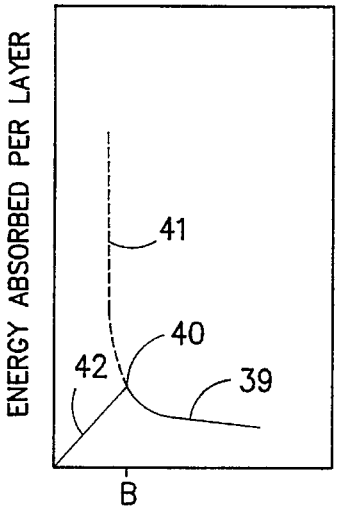
FIG. 8 is a graph of the actual curve of energy absorbed per layer versus the width of the strips of ballistic fabric when the strips of ballistic fabric are held by a clamp and the energy absorbed per layer is constrained.

If, for the convenience of testing, the ballistic fabric strips 22 are clamped in position prior to impact by projectile 10, then starting at a relatively wide strip, the energy absorbed rises, as indicated by numeral 39 in FIG. 8, until the width W of the ballistic fabric strip 22 is less than the side of the base B of the pyramid of deflection 14. At this point designated by numeral 40, the energy absorbed by the strip of ballistic fabric 22 will decrease to zero as shown by line 42 instead of becoming indefinitely great as shown by dashed line 41 as was previously the case with both the ideal curve 34 and the actual curve 36. At point 40, the pyramid of deflection 14 reaches the clamp thereby limiting the absorption of energy.

The distance B used to define the ballistic failure ratio may be found directly by high speed photography of the fabric under impact by a projectile of interest, or may be determined by reading off the width associated with the peak in the plot of accumulated test data such as that displayed in FIG. 9. In defining B, the discussion to this point has referred primarily to woven fabrics with balanced weaves. Such a fabric will produce a four sided pyramid with equal legs when struck by a projectile at normal incidence to the plane of the fabric. Other types of ballistic fabrics are possible, such as tri-axial weaves, unbalanced bi-axial weaves, non-wovens, and knits. These fabrics may not produce a deflection exactly as described above. For instance, a tri-axial weave will produce a six sided deflection pyramid while a knit may produce a deflection cone. Nevertheless, the B dimension may still be determined by seeking the width associated with the peak in the accumulated test data as described for balanced bi-axial weaves.

If more than one layer of ballistic fabric strips 22 are utilized, interactions between layers can be expected to increase the amount of energy absorbed per layer. The nature of this interaction is not completely understood, however, it can be hypothesized that it is due to the increase of the effective diameter of the projectile 10 as it is surrounded by layer after layer of the unpenetrated strips of ballistic fabric 22. This would thereby increase the size of the pyramid of deflection 14 for each layer in sequence starting from the first layer to receive the initial impact of the projectile 10. This interaction is plainly shown in FIG. 9, where one layer of a ballistic fabric strip, two layers of ballistic fabric strips, four layers of ballistic fabric strips, and five layers of ballistic fabric strips are plotted in terms of energy absorbed per layer versus width of strips and denoted by numerals 45, 46, 47, and 48 respectively. The additional strips of ballistic fabric 22 plainly enhance the energy absorbed per layer. The dashed lines 51, 52, 53, and 54 represent the probable trajectory of the curve if the distance between the clamped ends of the four (4) inch long ballistic fabric strips were considerably greater for one layer, two layers, four layers and five layers, respectively.

A graph depicting the energy absorption per layer of a ballistic fabric strip 22 versus percent reduction in width is found in FIG. 10. The line representing this relationship is designated by numeral 60 wherein the greater the reduction in width for a constant final width of 1.5 inches, the greater the energy absorption. If the ballistic fabric strips 22 are cut along the bias (forty-five degree line between the warp and weft yarns) and stretched to a final width, the energy absorption increases accordingly and if the ballistic fabric strips 22 are compressed along the bias to the same final width, the energy absorption decreases accordingly. Therefore, the greater the stretch along the length of the bias cut strip, the greater the energy absorbing capability. The resistance to penetration by sharp objects increases for the fabric stretched on the bias, even when the strips have a width wider than the ballistic failure ratio. This is because the fabric area is reduced by bias stretch or, in other words, the weave is compressed. This compression increases the yarn to yarn pressure. The yarns are thereby more resistant to being pushed aside when encountering a sharp object. This resistance to penetration is enhanced further when the bias stretched fabric is coated with a material with a coefficient of friction relatively higher than the base fabric. If the narrow ballistic fabric strips 22 were not cut along the bias, but instead were cut in the warp or weft direction, the energy absorption would not be nearly as great, since only one set of yarns 16 (either the warp or the weft) would be carrying most of the load. However, the energy absorbing characteristics would still be better than the parent ballistic fabric 12. Coating of the fabric strips on one or more sides, or embedding the strips in a matrix can provide several benefits. First, by coating and curing a bias stretched fabric, the stretch can be locked in. Second, the frictional resistance to yarn movement during impact can be increased. And third, fraying at the edges can be eliminated, thus avoiding manufacturing difficulties and improving aesthetics.

FIGS. 11 through 15 illustrate cross-sections of several layered constructions utilizing thin ballistic fabric strips 22. The widths of the strips 22 have been exaggerated for clarity. In FIG. 11, the ballistic fabric strips 22 are spot-glued down the center line of the longitudinal axis of the ballistic strips 22 as designated by numeral 61. In FIG. 12, the ballistic fabric strips 22 are glued on one side as designated by numeral 62. In FIG. 13, the ballistic fabric strips 22 are glued on both sides as designated by numerals 63 and 64, respectively. In FIG. 14, the ballistic fabric strips 22 are held together by vertical stitches as designated by numeral 65. In FIG. 15, the ballistic fabric 12 has perforations or slots 66 placed in the fabric to replicate the effect of strips.

FIG. 16 is a depiction of a bulletproof or protective vest 70 utilizing the ballistic fabric strips 22 glued on both sides as shown in FIG. 13. A top plan view of the ballistic fabric 12 shown in FIG. 15 having perforations therein which replicate the effect of ballistic strips 22 by not allowing the pyramid of deflection 14 achieve the breaking stress dimension is shown in FIG. 17.

Figure 18:
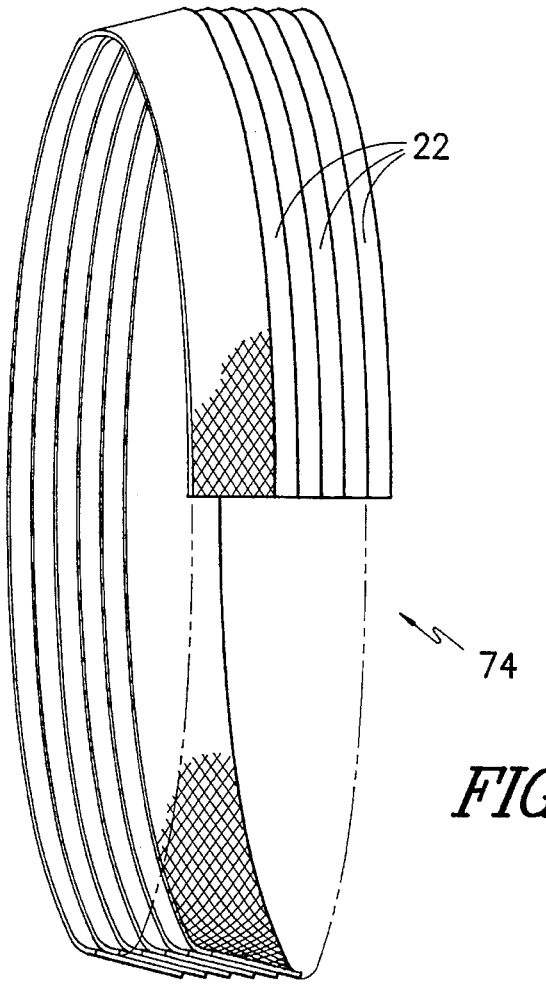
FIG. 18 is a perspective of a construction of ballistic fabric cut into strips and wound on a mandrel into a cylindrical shape.

FIG. 18 is a depiction of a series of ballistic fabric strips 22 helically wound on a mandrel in the form of a cylindrical shape 74. The ballistic strips are partially overlapping in a substantially staggered relationship. This construction may be used for containment of radially directed fragments such as those produced by damaged flywheels or turbine blades.

Figure 19:
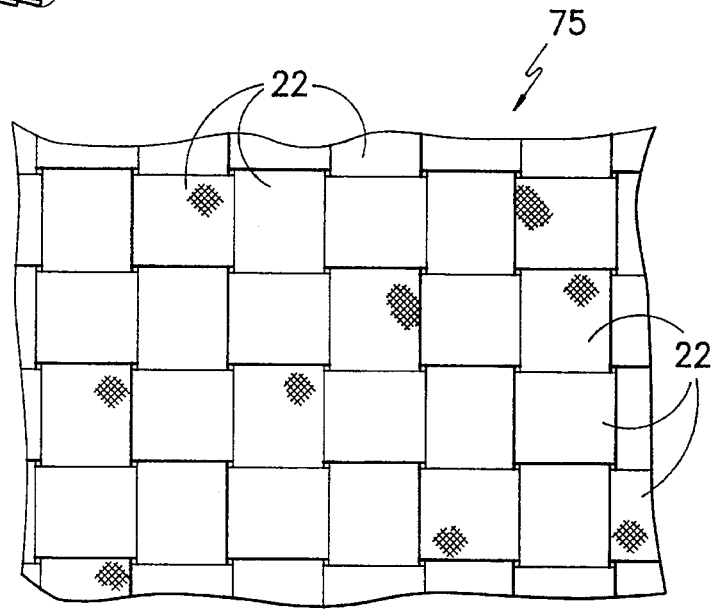
FIG. 19 is a top plan view of a construction of ballistic fabric cut along the bias and formed into strips and woven into fabric form.

FIG. 19 is a depiction of ballistic fabric strips 22 woven into the form of fabric 75. This woven fabric 75 can typically be utilized as a blast shield, however, there are a myriad of potential ballistic protection applications.

Figure 20:
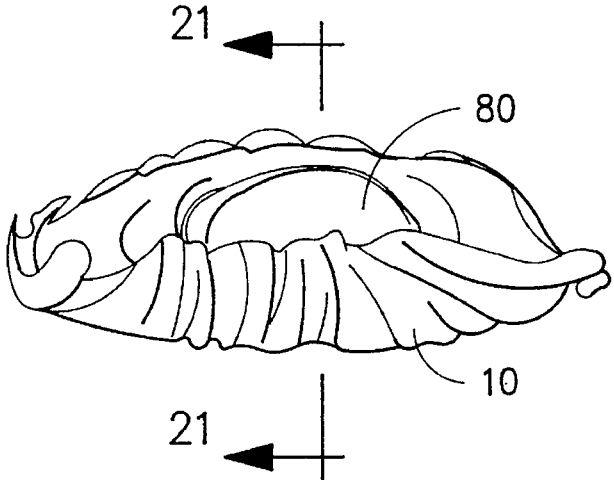
FIG. 20 is top view of a 0.22 caliber projectile where the projectile has been impacted against a coated ballistic fabric, as shown in FIG. 13, thereby demonstrating the results of asymmetrical loading.
Figure 21:
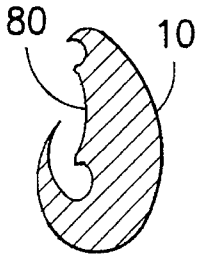
FIG. 21 is cross-sectional view taken on line 21—21 of FIG. 20 of the stopped projectile where the projectile shows edge curling due to asymmetrical loading.
Figure 22:
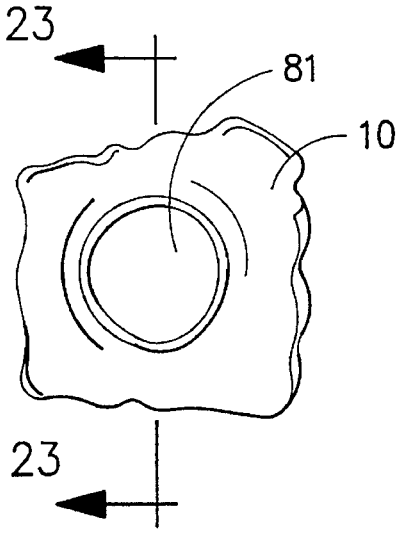
FIG. 22 is top view of a 0.22 caliber projectile where the projectile has been impacted against stacked layers of traditional ballistic fabric and wherein deformation of the projectile shows biaxial symmetry due to even loading in the warp and weft direction of the fabric.
Figure 23:
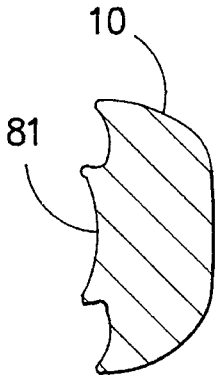
FIG. 23 is cross-sectional view taken on line 23—23 of FIG. 22 of the stopped projectile showing the symmetric deformation due to the symmetric loading by the traditional stacked layers of ballistic fabric.

FIG. 20 depicts a 0.22-caliber projectile (bullet) 80 that has impacted a fabric comprised of coated ballistic fabric strips 22 such as that shown in FIG. 13. When utilizing staggered strips 22, a projectile 80 must first impact near the vertical edge 25 as shown in FIG. 3. Yarns 16 placed in tension by the projectile 80 and intersecting the vertical edge 25 are pulled into the ballistic fabric strip 22. This motion of these yarns 16 produce a shear force across the face of the impacting projectile 80. This force produces a moment on the projectile 80, tending to rotate it about its center of gravity and also to deform the projectile 80 asymmetrically. This asymmetrically loading of the bullet 80 is advantageous as it tends to increase the energy absorption by both increasing the area of the bullet 80 and rotating it to present its long axis to the strips of ballistic fabric 22. A 0.22-caliber projectile 80 is also shown in a cross-sectional view with edge curling due to the asymmetrical loading. This presents a direct contrast to FIG. 22 that also depicts a 0.22-caliber projectile (bullet) 81 that has impacted a stack of traditional ballistic fabric 12 wherein the deformation of the projectile 81 shows biaxial symmetry due to even loading in the warp and weft direction of the fabric 12. FIG. 23 reveals a cross-sectional view of the projectile 81 of FIG. 22. showing the symmetric deformation due to the symmetric loading by the traditional stacked layers of ballistic fabrics.

Perforation of a sheet of ballistic fabric 12 is substantially equivalent to the cutting of ballistic fabric strips 22. The same effect of preventing a solid area of ballistic fabric from having a continuous area that accommodates a base of the pyramid of deflection will be accomplished.

It is not intended that the scope of the invention be limited to the specific embodiment illustrated and described. Rather, it is intended that the scope of the invention be defined by the appended claims and their equivalents.

What is claimed is:

1. A method for making ballistic-resistant fabric which comprises of cutting a plurality of strips of fabric each having a length and a width, made from fibers having a tenacity of at least ten grams/denier, at least one said strip of fabric having a ballistic failure ratio less than one for an impact with a projectile having a velocity of about at least five hundred feet per second, and a ratio of said length of said strip of fabric to said width of said strip of fabric greater then a reciprocal squared of said ballistic failure ratio and attaching said strips of fabric together in substantially overlapping relationship.

2. A method for making ballistic-resistant fabric which comprises of cutting at least one perforation in a plurality of sheets of fabric made from fibers having a tenacity of at least ten grams/denier, at least one portion of at least one sheet of fabric having a length and a width and having a ballistic failure ratio less than one for an impact with a projectile having a velocity of about at least five hundred feet per second, and a ratio of said length of said portion of said sheet of fabric to said width of said strip of fabric greater than a reciprocal squared of said ballistic failure ratio and attaching said plurality of sheets of fabric together in substantially overlapping relationship.

* * * * *